US011071924B2

(12) United States Patent
Scholz

(10) Patent No.: US 11,071,924 B2
(45) Date of Patent: Jul. 27, 2021

(54) THEATRICAL LIGHTNING SIMULATOR

(71) Applicant: Donald T. Scholz, Waltham, MA (US)

(72) Inventor: Donald T. Scholz, Waltham, MA (US)

( * ) Notice: Subject to any disclaimer, the term of this patent is extended or adjusted under 35 U.S.C. 154(b) by 0 days.

(21) Appl. No.: 16/604,614

(22) PCT Filed: Apr. 11, 2018

(86) PCT No.: PCT/US2018/027185
§ 371 (c)(1),
(2) Date: Oct. 11, 2019

(87) PCT Pub. No.: WO2018/191429
PCT Pub. Date: Oct. 18, 2018

(65) Prior Publication Data

US 2020/0376405 A1 Dec. 3, 2020

Related U.S. Application Data

(60) Provisional application No. 62/484,102, filed on Apr. 11, 2017.

(51) Int. Cl.

| | |
|---|---|
| ***A63J 5/02*** | (2006.01) |
| ***H05B 45/40*** | (2020.01) |
| ***H05B 47/155*** | (2020.01) |
| ***H05B 45/10*** | (2020.01) |

(52) U.S. Cl.
CPC ..... *A63J 5/02* (2013.01); *H05B 45/10* (2020.01); *H05B 45/40* (2020.01); *H05B 47/155* (2020.01)

(58) Field of Classification Search
CPC ..... A63G 31/00; A63G 31/16; G09G 5/00; G09G 3/2003; A63J 25/00; A63J 5/02
USPC ..... 472/61, 75; 345/156
See application file for complete search history.

(56) References Cited

U.S. PATENT DOCUMENTS

| | | | | |
|---|---|---|---|---|
| 5,982,112 | A | 11/1999 | Pringle et al. | |
| 6,746,139 | B2 * | 6/2004 | Sinzawa | B60Q 3/51 362/249.01 |
| 6,777,891 | B2 * | 8/2004 | Lys | F21V 21/002 315/291 |
| 2005/0275626 | A1 | 12/2005 | Mueller et al. | |
| 2010/0086349 | A1 | 4/2010 | Martinez et al. | |
| 2017/0343197 | A1 | 11/2017 | Gammons et al. | |

FOREIGN PATENT DOCUMENTS

EP 2778509 B1 3/2017

OTHER PUBLICATIONS

International Search Report and Written Opinion issued in PCT/US2018/027185 dated Jul. 19, 2019.

* cited by examiner

*Primary Examiner* — Kien T Nguyen
(74) *Attorney, Agent, or Firm* — Burns & Levinson LLP; Jerry Cohen

(57) ABSTRACT

An apparatus and method for theatrically representing lightning bolts provides a multiplicity of chip-on-board light-emitting-diode (COB-LED) sections arranged in a pattern representing one or more lightning bolts and individually powers each of the COB-LED sections to enable variation of light intensity and illumination timing.

5 Claims, 1 Drawing Sheet

THEATRICAL LIGHTNING SIMULATOR

CROSS-REFERENCE TO RELATED APPLICATIONS

This application is a U.S. national stage application under 35 U.S.C. 371 of co-pending International Application No. PCT/US2018/027185, filed on Apr. 11, 2108, and entitled THEATRICAL LIGHTNING SIMULATOR, which in turn claims priority to and benefit of U.S. Provisional Application No. 62/484,102, filed Apr. 11, 2017, which are incorporated by reference herein in their entirety for all purposes.

FIELD OF THE INVENTION

The present invention generally relates to lighting devices for entertainment events, and in particular to such devices which simulate lightning.

BACKGROUND OF THE INVENTION

Lighting for entertainment events is as old as entertainment events. Special lighting effects are used in a variety of entertainment formats. The simulation of lightning is one of those special effects, and it varies from simply short term illuminations to visual presentations with both illumination and sound effects to enhance the theatrical effect of the simulation. The term "theatrical" is used in the broad sense of acting, and in the present application as acting like lightning, even when applied to non-theatrical evens, such as music concerts. The effectiveness of such lightning simulators may be described as the theatrical effect of the simulation.

In view of the above discussion, it is a purpose of the present invention to provide a lightning simulation display.

It is a further purpose of the present invention to provide a lightning simulation display having flexibility in the visual display to enhance theatrical effects.

SUMMARY OF THE INVENTION

The present invention provides visual representations of lightning bolts formed from a multiplicity of individual LED lighting sections that are individually powered and controlled for varying the theatrical effect or simulation of different lightning bolts. The LED lighting sections may be sequentially illuminated to represent a travelling lightning bolt occurring at a distance from the observer, with variations in the illumination timing producing the effect of different distances from the observer. Likewise, different illumination intensities and/or durations can give the effect of either different distances or different lightning intensities. The individual LED lighting sections may also be alternatively illuminated to provide the effect of different lightning bolts. The lighting sections may be arranged in alternative paths, along with selective illumination, to provide the effect of different lightning bolts.

An apparatus is provided by mounting chip-on-board light-emitting-diode (COB-LED) sections in the pattern of one or more lightning bolts. Individual COB-LEDs vary in length and have closely spaced LEDs constructed therein in different numbers depending upon the length of the COB-LED. A pseudo-random arrangement of COB-LED sections provides the appearance of a lightning bolt. The COB-LED sections are mounted on fireproof material which may also act as a heat sink. The physical presentation may include additional design details that disguise the COB-LEDs and lightning bolt pattern until illumination.

One embodiment of the present invention provides a theatrical lightning simulator, comprising: a multiplicity of chip-on-board light-emitting-diode (COB-LED) lighting sections configured as one or more lightning bolts, wherein the multiplicity of COB-LED sections are powered and controlled individually enabling intensity and timing variation for each of the sections.

The multiplicity of COB-LED lighting sections may be affixed to a two dimensional or three dimensional display. The multiplicity of COB-LED sections may be arranged as multiple branches of a single lightning bolt, which multiple branches may be selectively illuminated to appear as different lightning bolts. The multiplicity of COB-LED sections may be mounted on a fireproof surface or on a heat sink surface. The surface may be two dimensional. The multiplicity of COB-LED sections may include three or more COB-LED sections.

The fireproof surface may include a visual design that disguises an overall appearance of the multiplicity of COB-LED sections when the multiplicity of COB-LED sections are not illuminated. The simulator may further comprise a visual design that disguises an overall appearance of the multiplicity of COB-LED sections when the multiplicity of COB-LED sections are not illuminated.

Another embodiment of the present invention provides a method for theatrically representing lightning bolts, comprising the steps of: providing a multiplicity of chip-on-board light-emitting-diode (COB-LED) sections arranged in a pattern representing one or more lightning bolts; individually powering each of the COB-LED sections to enable variation of light intensity and illumination timing; and controlling power to each of the sections to produce different lightning-like effects.

The method may further comprise sequentially powering adjacent COB-LED sections of the multiplicity of COB-LED sections to represent travel of a lightning bolt. The method may further comprise reducing timing between sequential powering of adjacent COB-LED sections to represent a relatively closer occurring lightning bolt. The may further comprise increasing lighting intensity of COB-LED sections to represent a relatively closer lightning bolt or a relatively larger lightning bolt. The method may further comprise illuminating less than all sequential COB-LED sections for a simulated lightning bolt.

The step of providing may include affixing the COB-LED sections of the multiplicity of COB-LED sections on a two-dimensional or three-dimensional display. The method may further comprise disguising an overall appearance of the multiplicity of COB-LED sections when the multiplicity of COB-LED sections are not illuminated.

BRIEF DESCRIPTION OF THE DRAWINGS

The present invention is illustratively shown and described in reference to the accompanying drawings, in which.

DETAILED DESCRIPTION OF THE DRAWINGS

Figure 1:
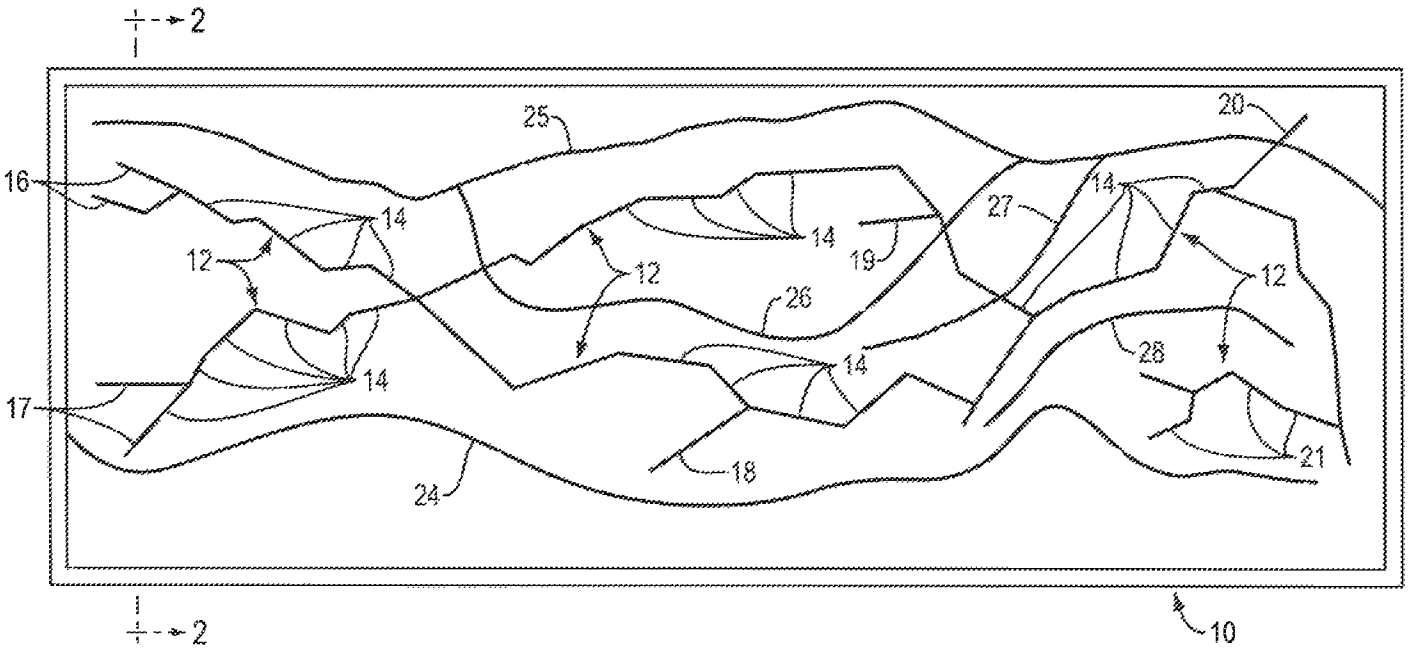
FIG. 1 is a plan view of a presentation surface of a theatrical lightning simulator constructed in accordance with an embodiment of the present invention.

FIG. 1 shows one embodiment of the present invention in which a visual display 10 is provided with a pattern 12 of different lightning bolt paths. The pattern 12 is comprised of a multiplicity of linear chip-on-board light-emitting-diode (COB-LED) sections 14 having a variety of lengths and collectively arranged in the patterns 12 of one or more lightning bolts.

Any suitable linear COB-LEDs may be used such as those provided by Vollong Electronics, which also distributes controllers for powering the individual LEDs. The COB-LEDs should be separately controllable, dimmable and have relatively short on and off switching times as LEDs normally would have. They should have varying lengths to help provide the appearance of randomness in the representation of a lightning bolt. The linear COB-LEDs may be straight or curved.

As shown in FIG. 1, COB-LED sections 14 are arranged in pseudo random patterns that form a connected pattern across display 10. Sections 14 also include parallel or alternative sections 16-21 which provide alternative illumination options. Parallel or alternative sections 16-21 may also be illuminated with their respective adjacent sections 14 to provide even more display options. Sections 16-21 enable further variation of the illuminated display by allowing the simulation of lightning either to or from any of the alternative sections 16-21.

Display 10 may also include various other visual design elements 24-28 which serve to disguise patterns 12 while sections 14 and 16-21 are not illuminated. Design elements 24-28 may be formed by any suitable visible means and may also serve additional functions such as the wiring for powering individual LED sections 14, 16-21. Design elements 24-28 may be passively visible or actively illuminated and even switched off during lightning simulation.

Figure 2:
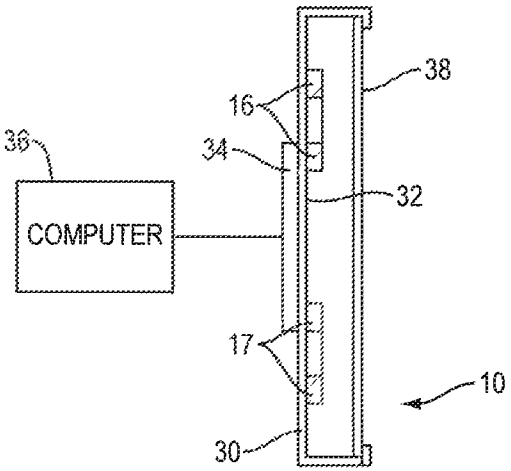
FIG. 2 is a sectional side view of the simulator of FIG. 1 taken along view lines 2-2.

FIG. 2 shows a cross-section of display 10 taken along view lines 2-2 in FIG. 1. Display 10 is shown to have a housing 30 with a right-facing surface 32 upon which COB-LED sections 16, 17 are mounted. Housing 30 or surface 32 are preferably formed from fireproof material, which may also serve a heat sink function. Power switching unit 34 is shown mounted to the back of housing 30 and may take advantage of the heat sinking qualities of housing 30. A computer 36 is shown connected to power switching unit 34. Housing 30 may also include a protective transparent cover 38 for COB-LEDs, which cover 38 may include additional graphics (not shown) and may also serve a function as part of design elements 24-28.

In operation, the present invention supports a variety of operational modes which can vary from simple manual operation to sensory related operation to fully computerized operation. The separate control of individual COB-LED sections is best handled by computerized operation but is not so limited to that mode. Alternatives include simple push-buttons that trigger one or more set sequences or configurations of illumination, or alternatively, sound sensors triggered by certain music frequencies.

Computerized control of COB-LED sections 14, 16-21 provides the greatest flexibility including sequential illumination of adjacent sections 14, 16-21 or alternative illuminations of different sets of sections 14, 16-21. Sequential illumination allows lightning to be simulated from opposing corner-located sections 16, 17, 20 and also through different patterns 12 of sections 14 for a significant variety of simulations. Illuminations may occur over the entire length of display 10 or may be localized to limited areas. Sequential illumination may be performed with different sequential timing and the illumination may be maintained for various periods, such as 50 milliseconds to 1 second. Sequential lightning bolts may also be simulated within a single illumination sequence. Lastly, the level of illumination may be controlled by varying the voltage connected to the COB-LED sections. This control aspect provides even further flexibility and realism to the simulations. All of the computerized illumination functions may be created by currently known computer programming methods. The previously mentioned sensory input for triggering illumination may also be combined with computerized control.

The present invention is illustratively described above in reference to the disclosed embodiments. Various modifications and changes may be made to the disclosed embodiments by persons skilled in the art without departing from the scope of the present invention as defined in the appended claims.

What is claimed is:

1. A theatrical lightning simulator, comprising:

a multiplicity of chip-on-board light-emitting-diode (COB-LED) lighting sections configured as one or more lightning bolts, wherein the multiplicity of COB-LED sections are powered and controlled individually enabling intensity and timing variation for each of the sections and wherein the multiplicity of COB-LED sections are arranged as multiple branches of a single lightning bolt, which multiple branches may be selectively illuminated to appear as different lightning bolts.

2. A theatrical lightning simulator, comprising:

a multiplicity of chip-on-board light-emitting-diode (COB-LED) lighting sections configured as one or more lightning bolts, wherein the multiplicity of COB-LED sections are powered and controlled individually enabling intensity and timing variation for each of the sections and, wherein the multiplicity of COB-LED sections are mounted on a fireproof surface, wherein the fireproof surface includes a visual design that disguises an overall appearance of the multiplicity of COB-LED sections when the multiplicity of COB-LED sections are not illuminated.

3. A theatrical lightning simulator, comprising:

a multiplicity of chip-on-board light-emitting-diode (COB-LED) lighting sections configured as one or more lightning bolts, wherein the multiplicity of COB-LED sections are powered and controlled individually enabling intensity and timing variation for each of the sections and wherein the simulator includes a visual design that disguises an overall appearance of the multiplicity of COB-LED sections when the multiplicity of COB-LED sections are not illuminated.

4. A method for theatrically representing lightning bolts, comprising the steps of:

providing a multiplicity of chip-on-board light-emitting-diode (COB-LED) sections arranged in a pattern representing one or more lightning bolts;

individually powering each of the COB-LED sections to enable variation of light intensity and illumination timing;

controlling power to each of the sections to produce different lightning-like effects; and further comprising sequentially powering adjacent COB-LED sections of the multiplicity of COB-LED sections to represent travel of a lightning bolt; and further comprising reducing timing between sequential powering of adjacent COB-LED sections to represent a relatively closer occurring lightning bolt.

5. A method for theatrically representing lightning bolts, comprising the steps of:

providing a multiplicity of chip-on-board light-emitting-diode (COB-LED) sections arranged in a pattern representing one or more lightning bolts;

individually powering each of the COB-LED sections to enable variation of light intensity and illumination timing;

controlling power to each of the sections to produce different lightning-like effects; and further comprising disguising an overall appearance of the multiplicity of COB-LED sections when the multiplicity of COB-LED sections are not illuminated.

* * * * *